US006336279B1

(12) United States Patent
Orso

(10) Patent No.: US 6,336,279 B1
(45) Date of Patent: Jan. 8, 2002

(54) SKI BOOT

(75) Inventor: Piero Orso, Cassola (IT)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 09/692,478

(22) Filed: Oct. 19, 2000

(30) Foreign Application Priority Data

Oct. 29, 1999 (CH) ..... 1986/99

(51) Int. Cl.[7] ..... A43B 5/00
(52) U.S. Cl. ..... 36/117.1; 36/118.2; 36/119.1
(58) Field of Search ..... 36/117.1, 118.2, 36/118.3, 119.1

(56) References Cited

U.S. PATENT DOCUMENTS 4,372,061 A * 2/1983 Pozzobon
4,406,073 A * 9/1983 Spademan
4,561,196 A 12/1985 Petrini et al.
5,054,215 A 10/1991 Tonel et al.
5,553,402 A * 9/1996 Marega et al. ..... 36/118.2
5,819,442 A 10/1998 Orso
5,867,924 A 2/1999 Gattelet
5,979,082 A * 11/1999 Pallatin ..... 36/118.2

FOREIGN PATENT DOCUMENTS

CH 0685178 A 10/1990
EP 0302414 A 2/1989
EP 350023 * 1/1990
FR 2506135 A 11/1982
FR 2649594 1/1991

* cited by examiner

*Primary Examiner*—M. D. Patterson
(74) *Attorney, Agent, or Firm*—John Moetteli; Bugnion S.A.

(57) ABSTRACT

Ski boot has a shell (1), a collar (4) articulated on the shell and an inner reinforcement element (7) fixed to the collar. The reinforcement element is in the form of a half-collar surrounding the upper edge of the shell. The boot has a wedge-shaped projection (12) of the reinforcement for making the reinforcement interfere with the shell. The projection (12) engages in a notch (13) of the shell, in such a manner that the reinforcement element controls the flexibility of the boot.

8 Claims, 2 Drawing Sheets

Fig.1
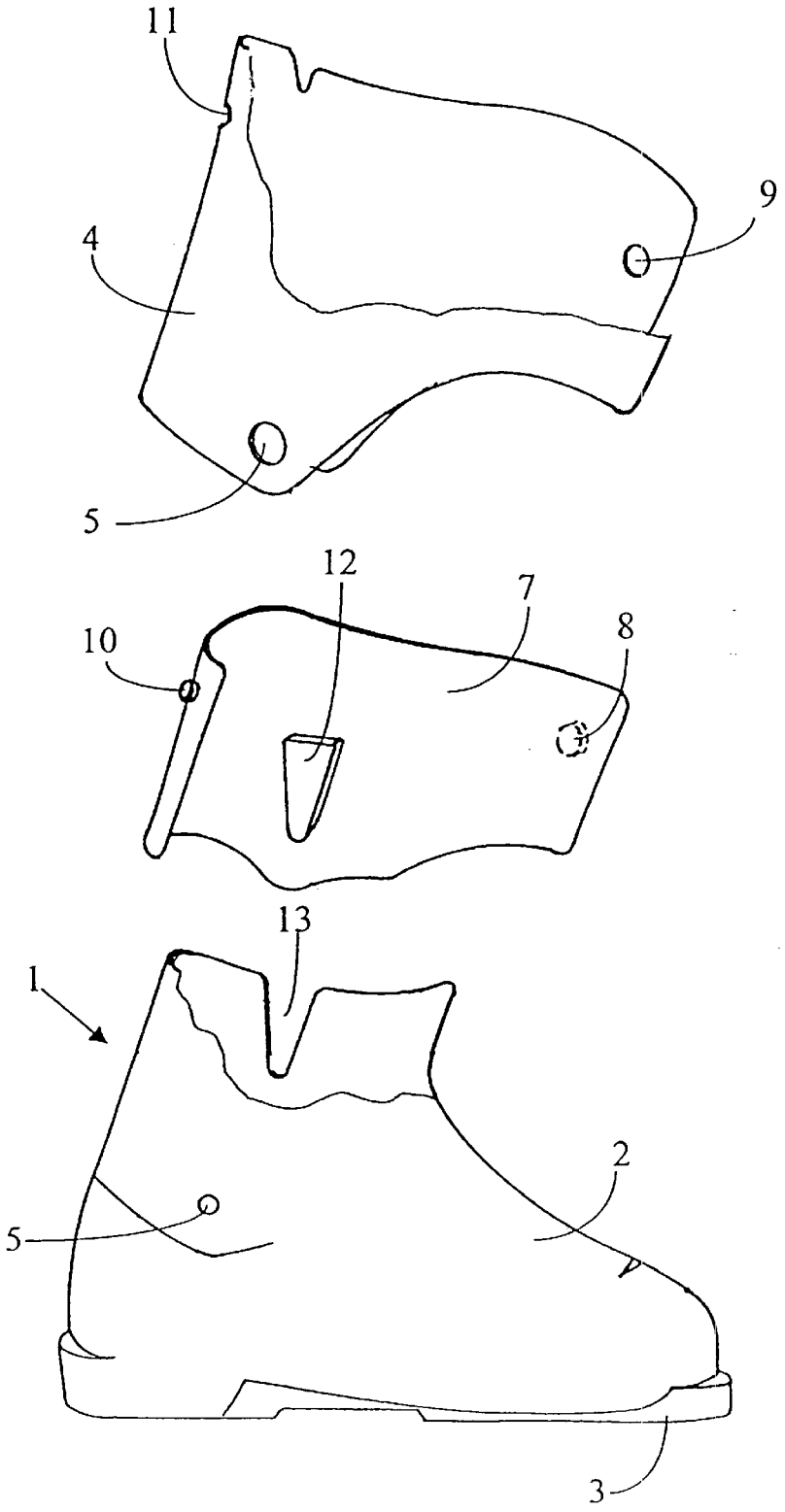
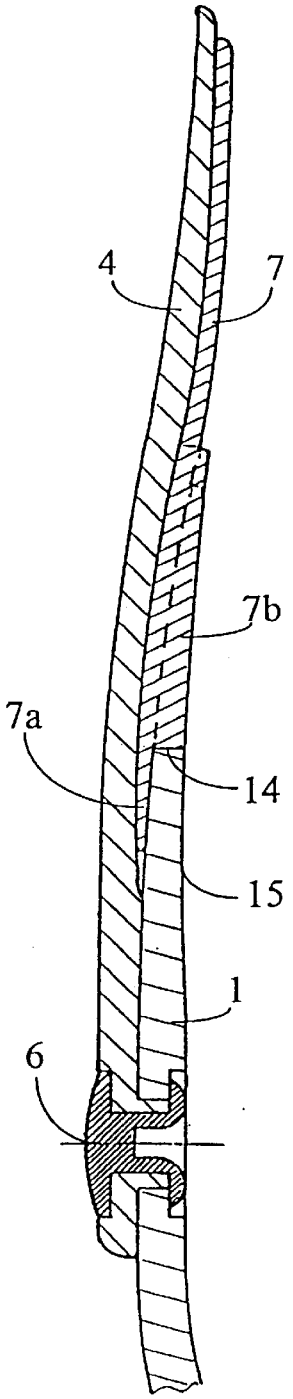
Fig.2

SKI BOOT

BACKGROUND OF THE INVENTION

The subject of the present invention is a ski boot consisting essentially of a shell forming the sole and the upper and of a lower-leg collar articulated on the shell and equipped with an inner reinforcement element fixed to the collar and reinforcing the side of the boot which corresponds to the inner side of the leg.

A boot of this type is known from Patent FR 2,649,594, the content of which is incorporated by reference. In this boot, the collar is equipped with a reinforcement having a relatively rigid plate fixed adjustably and removably to the inner face of the collar. This plate is made from synthetic material, but could be made from metal or from glass fibers or from carbon fibers. Its aim is to improve the quality of transmission of the sideways force of the leg to the ski so as to improve ski control. Otherwise, this boot behaves as a boot without reinforcement, particularly as regards being put on and taken off.

U.S. Pat. No. 5,867,924, the content of which is incorporated by reference, discloses, moreover, a ski boot whose collar is equipped with a front plate serving as a support for the tibia. In U.S. Pat. No. 5,819,442, the content of which is incorporated by reference, furthermore, describes use of auxiliary reinforcement pieces of asymmetric shape which, depending on their position, make it possible to improve the dynamic characteristics of the boot either for slalom and skiing on ice or for downhill skiing. These pieces are fixed removably under the front part of the collar.

SUMMARY OF THE INVENTION

The present invention has a different aim. Its object is to improve comfort and to make it easier to put the boot on and to take it off without prejudicing the performance levels of the boot, i.e. its dynamic characteristics. In other words, the invention is a boot manufactured using flexible and therefore comfortable materials, the dynamic characteristics of which, particularly support toward the inside and toward the front, and flexing, are modified by the addition of the reinforcement.

To this end, the boot according to the invention is defined in that the reinforcement element has a semi-rigid piece in the form of a half-collar fixed to the collar, the semi-rigid piece surrounding the upper edge of the shell over slightly more than half of the periphery of the collar, and having a means for making the reinforcement interfere with the shell so that the reinforcement element controls the flexibility of the boot during flexing of the leg.

In this way, it is possible to produce a boot whose shell is relatively flexible and comfortable, in which inner-side support and tibia support is ensured by the reinforcement piece, when the collar is closed. When the collar is opened to be put on or take off the boot, it releases the flexibility of the shell in such a manner that the latter may be more easily put on and taken off.

A further considerable advantage of the invention is the possibility, due to a minimum shell flexibility (for example 54 Shore D) and a relatively flexible collar, of producing boots of different rigidity by means of the addition of a reinforcement which is varies in thickness. This greatly facilitates stock management.

According to a preferred embodiment of the invention, the inner side of the upper edge of the shell has a V-shaped notch and the reinforcement element has, on its inner face, a wedge-shaped projection which, in the closed position of the boot, fits into the V-shaped notch. The effect of the V-shaped notch is to facilitate opening of the shell for putting the boot on, the wedge-shaped projection of the reinforcement element eliminating this additional flexibility once the boot has been put on.

Moreover, the reinforcement piece advantageously bears frontally against the upper edge of the shell, ensuring continuity of thickness and continuity of the inner face of the shell.

BRIEF DESCRIPTION OF THE DRAWINGS

The appended drawings show, by way of example, an embodiment of the invention and a variant thereof.

FIG. 1 is an exploded view of the shell, collar and reinforcement element.

FIG. 2 is a side, cross-sectional view, on a larger scale, through one joint of the collar on the shell.

DESCRIPTION OF THE PREFERRED EMBODIMENTS

Figure 3:
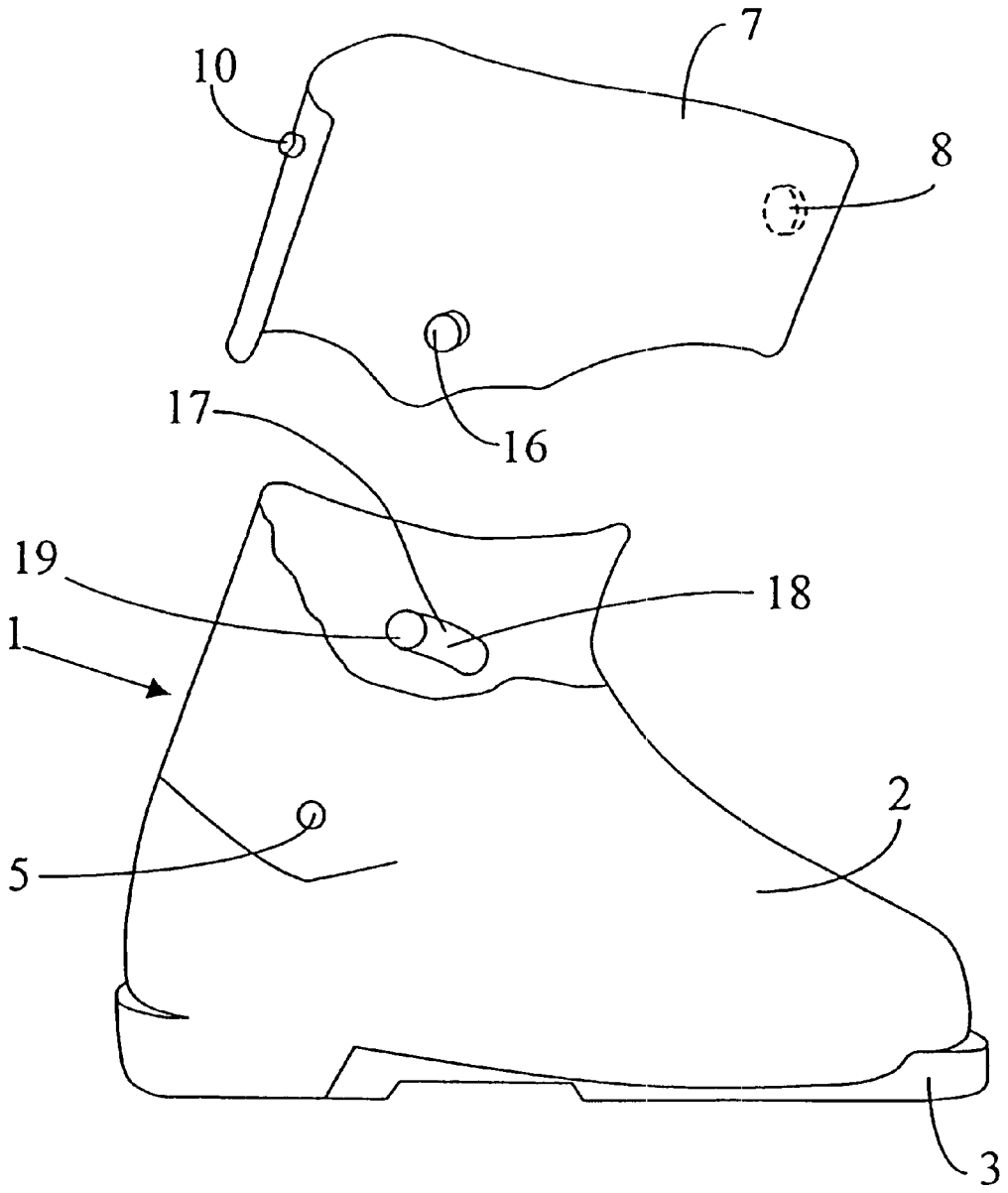
FIG. 3 is a side, partial break-away view of an alternate embodiment.

The boot shown has (1) a shell 1 which forms, in a known manner, the upper 2 which closes over the front of the boot via two tabs and the sole 3 of the boot, (2) a collar 4 articulated on the shell 1, on each side of the latter, at two opposite points, such as the point 5, by means of a rivet 6 (FIG. 2), and (3) a reinforcement element 7. All these pieces are injection-molded pieces made, for example, from polyurethane with the addition of an additive so as to obtain a greater or lesser rigidity, this being in a known manner.

The material of the shell 1 has, for example, a rigidity of 54 Shore D, which is approximately the minimum hardness for such an application. The collar 4 is relatively flexible whereas the reinforcement element 7 has a rigidity which is greater than that of the shell 1.

The reinforcement element 7 extends over slightly more than half of the periphery of the collar 4. At the front, it has a stud 8 which, from the inside of the collar 4, fits into a hole 9 in said collar and, at the rear, a second stud 10 which fits into a hole 11 made in the back of the collar 4. The reinforcement element 7 therefore extends on each side of the hole 11 so that it partially surrounds the bottom of the calf.

On its inner face, the reinforcement element 7 has a wedge-shaped projection 12 oriented substantially vertically. This projection 12 is formed from an excess thickness of the material of the reinforcement element. For its part, the upper edge of the shell 1, on the side corresponding to the inside of the foot, has a notch 13 which is also V-shaped and is geometrically similar to the shape of the projection 12 and substantially of the same extent. When the pieces shown are assembled, the projection 12 is engaged in the notch 13.

The effect of the notch 13 is to increase the deformation capacity of the upper part of the shell 1 and consequently to facilitate putting the boot on and taking it off, releasing the shell tabs. On the other hand, when the collar 4 is tightened around the leg, the notch 13 is occupied by the projection 12 in such a manner that the shell becomes nondeformable and that flexibility is greatly reduced. Thus, by means of a single reinforcement, inner front support (and thus ski behavior) and dynamic rigidity of the boot are simultaneously improved.

FIG. 2 shows that the reinforcement element 7 has a thinned lower part 7*a* surrounding the upper edge of the shell 1. Above this thinned part, the reinforcement element 7 has a relatively thick zone 7*b* bearing frontally against the upper edge 14 of the shell 1 so as to ensure continuity of the inner face 15 of the shell. Moreover, above the lower edge of the part 7*a*, the shell thins slightly, as does the collar 4. A certain continuity of the overall thickness is thus ensured in the superposition zone of the shell, of the collar and of the reinforcement element.

Naturally, the boot has conventional tightening means, such as buckles, and also an inner comfort boot.

According to an alternate embodiment, the angle of the notch 13 is larger than the angle formed by the projection 12, and the space remaining between at least one side of the notch 13 and the projection is filled with an elastomeric material. The angle of the notch 13 is enlarged only towards the front, so that the elastomer would be only in front of the projection, thus conferring a degree of elasticity during flexing of the leg.

FIG. 3 shows a variant embodiment in which the projection 12 is replaced by a stud 16 and the V-shaped notch 13 is replaced by an aperture 17 cut into the shell 2, in the shape of an arc of a circle centered on the articulation 5. The front part of this aperture 17 is occupied by an elastomeric material 18, such as rubber, leaving free a hole 19 in which the stud 16 engages during closure of the collar. In forward flexion, the elastic material 18 gives the collar greater flexibility.

The aperture 17 could be replaced by a hole corresponding to the hole 19.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing descriptions be construed broadly and understood as being given by way of illustration and example only, the spirit and scope of the invention being limited only by the appended claims.

What is claimed:

1. A ski boot having a shell (1) forming the sole and the upper and of a lower-leg collar (4) articulated on the shell and equipped with an inner reinforcement element (7) fixed to the collar and reinforcing the side of the boot which corresponds to the inner side of the leg, wherein the reinforcement element (7) has a semi-rigid piece in the form of a half-collar fixed to the collar and surrounding the upper edge of the shell over slightly more than half of the periphery of the collar, and wherein the boot comprises means (12, 13; 16; 17) for making the reinforcement interfere with the shell so that the reinforcement element controls the flexibility of the boot during flexing of the leg.

2. The boot as claimed in claim 1, wherein the interference means comprises firstly of a V-shaped notch (13) formed on the inner side of the upper edge of the shell (1) and, secondly, a wedge-shaped projection (12) on the inner face of the reinforcement element (7), this projection fitting into said notch (13).

3. The boot as claimed in claim 2, wherein the projection (12) has a geometrical shape similar to the shape of the notch (13).

4. The boot as claimed in claim 2, wherein the angle of the V-shaped notch (13) is greater than the angle formed by the projection (12), and wherein the space between the projection and at least one of the sides of the notch is occupied by an elastomeric material in such a way that the projection and the elastomeric material together fill the V-shaped notch.

5. The boot as claimed in claim 1, wherein the interference means comprises firstly of a stud (16) on the inner face of the reinforcement and secondly of a hole (19) in the shell, the stud fitting into the hole.

6. The boot as claimed in claim 5, wherein said hole (19) is formed at the end of an aperture (17) in the shape of an arc of a circle centered on the articulation (5) of the collar and occupied, with the exception of the hole, by an elastomer.

7. The boot as claimed in one of claims 1 to 6, wherein the reinforcement element (7) surrounds the shell by means of a thinned part (7*a*), and wherein the zone (7*b*) of the reinforcement element located above this thinned part bears frontally on the end of the edge of the shell, ensuring continuity of the inner face of the shell.

8. The boot as claimed in claim 7, wherein the region of the shell surrounded by the thinned part (7*a*) of the reinforcement element is itself thinned, and wherein the collar (4) is also thinned toward the top from said thinned part in such a manner that a continuity of thickness is ensured in the superposition zone of the shell, of the reinforcement element and of the collar.

* * * * *